US005727938A

United States Patent [19]

Knöpfel

[11] Patent Number: 5,727,938

[45] Date of Patent: Mar. 17, 1998

[54] PREMIX BURNER

[75] Inventor: Hans Peter Knöpfel, Besenbüren, Switzerland

[73] Assignee: ABB Research Ltd., Zurich, Switzerland

[21] Appl. No.: 747,571

[22] Filed: Nov. 12, 1996

[30] Foreign Application Priority Data

Dec. 2, 1995 [DE] Germany ..... 195 45 036.1

[51] Int. Cl.[6] ..... F23Q 9/00

[52] U.S. Cl. ..... 431/285; 431/115; 431/354

[58] Field of Search ..... 431/115, 285, 431/354

[56] References Cited

FOREIGN PATENT DOCUMENTS

0436113A1 7/1991 European Pat. Off. .

0629817A2 12/1994 European Pat. Off. .

4320212A1 12/1994 Germany .

*Primary Examiner*—Carroll B. Dority

*Attorney, Agent, or Firm*—Burns, Doane, Swecker & Mathis, L.L.P.

[57] ABSTRACT

In a premix burner which essentially comprises at least two hollow conical sectional bodies (1, 2) which are nested one inside the other in the direction of flow and form an interior space (14), tangential air-inlet slots (21, 22) are formed by offsetting the center axes (1*b*, 2*b*) of these sectional bodies from one another. Feed ducts (25, 26) extend upstream of these tangential air-inlet slots, which feed ducts (25, 26) each end with an injector system (200) for the provision of combustion air (15) consisting of fresh air (19) and flue gas (20). A perforated plate (23, 24) belonging to the injector system runs parallel to the inflow planes (30, 40) of the feed ducts and is provided with injector nozzles (23*a*, 24*a*) whose inflow angle varies continuously in the longitudinal direction of the premix burner relative to the burner axis.

8 Claims, 3 Drawing Sheets

PREMIX BURNER

DISCUSSION OF BACKGROUND

Publication EP-A2-0 629 817 has disclosed a premix burner which is extended with injectors for flue-gas recirculation. In the case of liquid fuels, the flue gases help to vaporize these liquid fuels. In particular, however, these flue gases serve to reduce the flame temperature, which leads to lower NOx emissions. In this publication, the arrangement of the injectors is run across the entire burner length along the tangential air-inlet slots in such a way that the axes of the injectors and therefore their outflow directions are perpendicular to the tangential air-inlet slots or the burner axis. This arrangement results in a purely tangentially directed flow profile in the region of the said air-inlet slots. For the premix burner itself, this configuration results in the following imperfections or shortcomings in certain types of operation:

a) increase in the risk of flashback of the flame into the interior of the premix burner;

b) the consequence of a) is then that the operating range with an optimum flame position remains restricted;

c) the combustion is subjected to pulsations which lead in various ways to destabilization of the flame position and/or to an increase in the pollutant emissions, in particular the NOx emissions;

d) considerable deviations with regard to the optimum flow conditions arise, as a result of which the potential of the premix burner cannot be fully utilized;

e) the starting procedure is difficult to operate on account of the abovementioned shortcomings.

SUMMARY OF THE INVENTION

Accordingly, one object of the invention, in a premix burner of the type mentioned at the beginning, is to optimize the flow conditions crucial for removing the said imperfections and shortcomings.

The essential advantage of the invention may be seen in the fact that the main body of the premix burner is not altered in any way; only the introduction of fresh air into the tangential feed ducts, which extend upstream from the tangential air-inlet slots, is adapted to the optimum flow field for the burner. This is achieved by the injector planes being kept parallel to the inflow plane of the said feed ducts, irrespective of how the respective inflow plane runs, while the axes of the individual injector nozzles are appropriately adapted along the axial course of the inflow plane in the direction of flow of the premix burner. This adaptation may be effected continuously; i.e., from an oblique inflow plane, i.e. an inflow plane running at an acute angle relative to the burner axis in the direction of flow, in the area of the head stage of the premix burner, this angle assumes an approximately perpendicular position relative to the burner axis of the premix burner up to the outlet of the premix burner. The achievement of an optimum flow field is directly reflected in the quality of the backflow zone, forming at the outlet of the premix burner, in such a way that the backflow zone turns out to be positionally stable and is no longer adversely affected by fluidic interference.

Advantageous and expedient further developments of the achievement of the object according to the invention are defined in the further claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
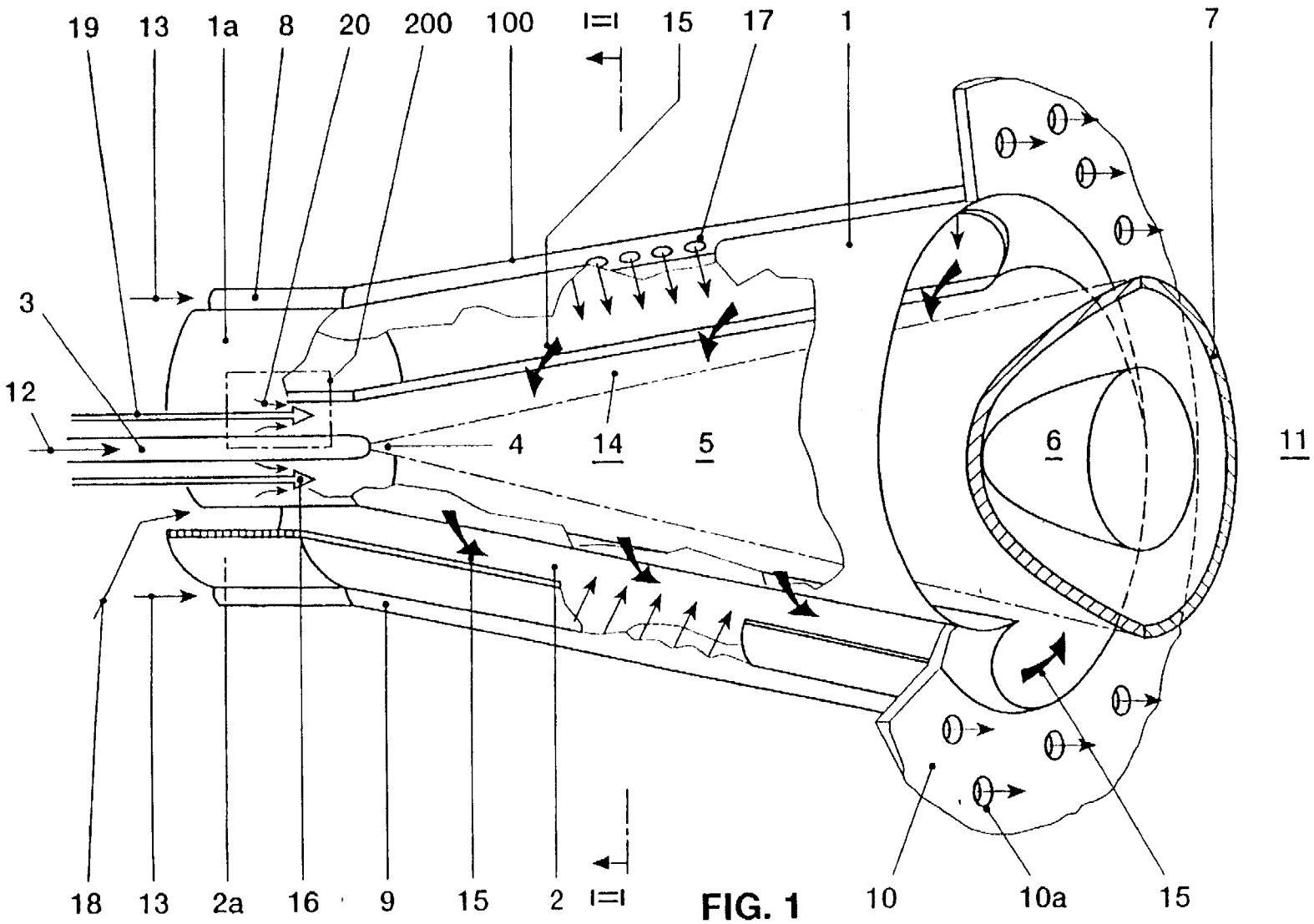
FIG. 1 shows a premix burner in perspective representation, in appropriate cut-away section.
Figure 2:
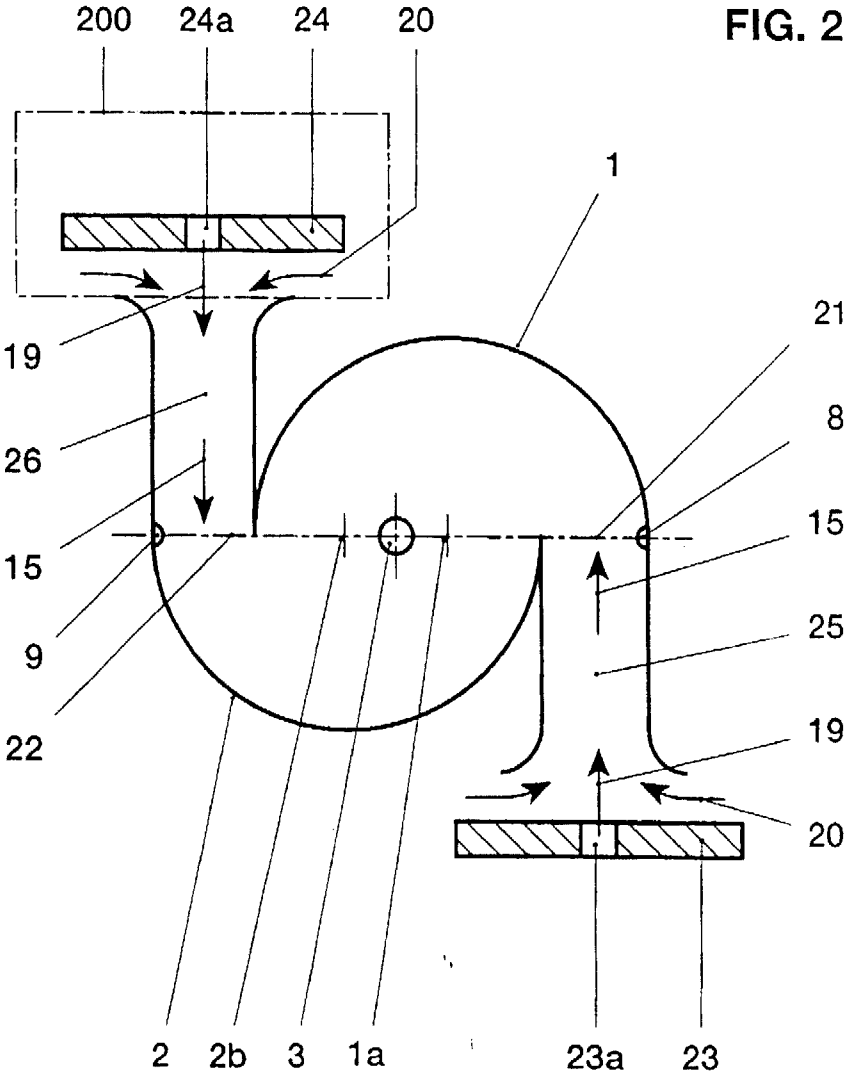
FIG. 2 shows a section through the plane II—II of FIG. 1, the inflow plane of the feed ducts for a combustion-air flow running parallel to the burner axis, which inflow plane is equipped with injectors.

Referring now to the drawings, wherein like reference numerals designate identical or corresponding parts or sequences throughout the several views, all elements not essential for directly understanding the invention are omitted, and the direction of flow of the various media is indicated by arrows, FIGS. 1–5 should be consulted at the same time in order to better understand the construction of the premix burner 100. Furthermore, so that FIG. 1 is not made unnecessarily complex, the injectors shown for example in FIG. 2 and the feed ducts, serving as mixing sections, up to the interior space of the premix burner have not been shown graphically therein. The premix burner 100 according to FIG. 1 consists of two hollow conical sectional bodies 1, 2 which are nested one inside the other in a mutually offset manner. The number of sectional bodies required to form the premix burner 100 is of course not restricted to two. The conical form of the sectional bodies 1, 2 shown has a certain fixed angle in the direction of flow. The sectional bodies 1, 2 may of course have another opening configuration in the direction of flow, for example regularly or irregularly increasing or decreasing conicity, for instance in the form of a diffuser or confuser. The two last-mentioned shapes are not shown graphically, since they can readily be visualized by a person skilled in the art. Which shape is ultimately selected depends on the various parameters of the respective combustion. The mutual offset of the respective center axis 1*b*, 2*b* of the conical sectional bodies 1, 2 provides on both sides, in axially symmetrical arrangement, one tangential air-inlet slot 21, 22 (cf. FIG. 2) each and an axial inflow cross section 18 through which the combustion air 15, 16 consisting of a fresh-air/flue-gas mixture flows into the interior space 14 of the premix burner 100. The two conical sectional bodies 1, 2 each have a cylindrical initial part 1*a*, 2*a*, which likewise run offset from one another in a manner analogous to the sectional bodies 1, 2 so that the tangential air-inlet slots 21, 22 are present over the entire length of the premix burner 100. The premix burner 100 may of course be of purely conical design, that is without cylindrical initial parts la, 2*a*. At least one fuel nozzle 3 is accommodated in this cylindrical initial part 1*a*, 2*a*, which is especially suitable, for example, as a seat for the anchoring of the entire premix burner 100. In addition, a number of injectors 200 are also accommodated there, which supply the combustion air 16 fed axially and likewise composed of fresh air and flue gas. Reference is male to FIG. 2 for the configuration of these injectors 200. According to requirements, both sectional bodies 1, 2 each have a fuel line 8, 9 extending in axial direction, which fuel lines 8, 9 are provided with a number of nozzles 17. A gaseous fuel 13 is preferably directed through these lines, which fuel 13 is added through the said nozzles 17 in the region of the tangential air-inlet slots 21, 22 (cf. FIG. 2) to the combustion air 15 flowing through there. The premix burner 100 may be operated solely with the fuel feed via the nozzle 3, or via the nozzles 17. Mixed operation via the two fuel nozzles 3, 17 is of course possible, in particular when different fuels are fed via the individual nozzles. On the combustion-space side 11, the premix burner 100 has a collar-shaped plate or front wall 10 which has a number of bores 10*a* through which diluent or cooling air is fed to the front part of the premix burner 100. If a liquid fuel 12 is fed via the nozzle 3, this liquid fuel 12 is injected at an acute angle into the interior space 14 of the premix burner 100 in such a way that as homongeneous a conical spray pattern 5 as possible appears up to the burner discharge plane. The fuel injection may involve an air-assisted nozzle or a nozzle which works according to the pressure-atomizing principle. In accordance with the number of air-inlet slots 21, 22, the conical spray pattern 5 is enclosed by tangentially inflowing combustion-air flows 15 and by the axially fed, further combustion air 16. The concentration of the injected fuel 12 is continuously reduced in the direction of flow of the premix burner 100 by the said combustion-air flows 15, 16. If a gaseous fuel 13 is introduced, the formation of the mixture with the combustion air 15 starts in the region of the air-inlet slots 21, 22 possibly upstream of the same. When a liquid or even a gaseous fuel is used, the optimum, homogeneous fuel concentration across the cross section is achieved in the region of the vortex breakdown, that is in the region of the backflow zone 6 at the end of the premix burner 100. The ignition of the fuel/combustion-air mixture starts at the tip of the backflow zone 6. Only at this point can a stable flame front 7 develop. A flashback of the flame into the interior of the premix burner 100, as is always to be feared in the case of known premix sections, where it is attempted to remedy this with complicated flame retention baffles, need not be feared here. If the combustion air 15, 16, that is the air/flue-gas mixture, is also possibly preheated, accelerated, integral vaporization of the liquid fuel 12 occurs before the spot at the outlet of the premix burner 100 is reached at which the ignition of the mixture can take place. The degree of vaporization depends on the size of the premix burner 100, the droplet size of the fuel 12, the temperature and the composition of the combustion-air flows 15, 16. The minimizing of the pollutant emissions is causally dependent upon the degree of flue-gas recirculation, which ensures complete vaporization of the fuel before entry to the combustion zone. Narrow limits are to be adhered to in the configuration of the conical sectional bodies 1, 2 with regard to conicity and width of the tangential air-inlet slots 21, 22 so that the desired flow field, that is the critical swirl coefficient, of the combustion air arises with its backflow zone 6 in the region of the orifice of the premix burner 100 for flame stabilization. In general, it may be said that a reduction in the air-inlet slots 21, 22 displaces the backflow zone 6 further upstream, although this would then result in the mixture being ignited earlier. Nonetheless, it may be said here that the backflow zone 6, once it is fixed locally, is positionally stable per se, since the swirl coefficient increases in the direction of flow in the region of the conical form of the premix burner 100. The cross section of flow of the tangential air-inlet slots 21, 22 may of course be designed to be variable in the direction of flow, for example to decrease in the direction of flow, in order to make the backflow zone 6 more stable at the outlet of the premix burner 100. Furthermore, the axial velocity of the mixture can be influenced by the axial feeding of combustion air 16 already mentioned. On the combustion-space side 11, the cross section of flow there undergoes over the said front wall 10 a jump in cross section (not shown in the figure), the cross section of which forms the cross section of flow of at least a first section of the combustion space 11. The said backflow zone 6 also forms in this plane. The design of the premix burner 100, at a specified overall length of the same which is not to be exceeded, is extremely suitable for varying the gap width of the tangential air-inlet slots 21, 22 by virtue of the fact that the sectional bodies 1, 2 can be displaced towards or away from one another, as a result of which the distance between the two center axes 1*b*, 2*b* decreases or increases, as can readily be deduced from FIG. 2. It is also readily possible to displace the conical sectional bodies 1, 2 one inside the other by a rotating movement. It is therefore possible, if appropriate arrangements are made, to vary the shape and the size of the tangential air-inlet slots 21, 22 during operation, whereby the same premix burner 100 can cover a wide operational range without changing the overall length.

As already mentioned briefly, the number of sectional bodies 1, 2 is not restricted to two. A larger number is also readily possible and is even desired in certain types of operation. If spiral conduction of flow of the combustion air 15 into the interior space 14 is desired, this can readily be achieved via a single tangential air-inlet slot.

If the premix burner to be formed by the sectional bodies consists of a single continuous tube, the tangential injections into the interior space can be achieved by duct-like leadthroughs through the wall thickness of this very same tube.

FIG. 2 is a section approximately in the center of the premix burner 100 according to section plane II—II from FIG. 1. The feed ducts 25, 26 arranged tangentially in mirror image perform the function of a mixing section, in which feed ducts 25, 26 the final mixture formation between fresh air 19 and recycled flue gas 20 is perfected. The combustion air 15 is prepared in an injector system 200; the axially fed combustion air 16 is likewise prepared in an injector system (cf. FIG. 1). Upstream of each feed duct 25, 26, which serves as a tangential inflow into the interior space 14 of the premix burner 100, the fresh air 19 is uniformly distributed over the entire length of this premix burner via perforated plates 23, 24. These perforated plates 23, 24 are perforated in the direction of flow toward the tangential inlet slots 21, 22. The perforations perform the function of individual injector nozzles 23*a*, 24*a* which exert a suction effect relative to the surrounding flue gas 20 in such a way that each of these injector nozzles 23*a*, 24*a* in each case draws in only a certain portion of flue gas 20, whereupon uniform flue-gas admixing takes place over the entire axial length of the perforated plates 23, 24, which corresponds to the burner length. This configuration causes intimate mixing to take place as early as at the contact location of the two media, that is of the fresh air 19 and the flue gas 20, so that the flow length, extending up to the tangential air-inlet slots 21, 22, of the feed ducts 25, 26 for the mixture formation can be minimized. In addition, the injector configuration 200 here is distinguished by the fact that the geometry of the premix burner 100, in particular as far as the shape and size of the tangential air-inlet slots 21, 22 are concerned, remains dimensionally stable, i.e. no thermally induced distortions develop due to the uniformly metered distribution of the flue gases 20, hot per se, along the entire axial length of the premix burner 100. The same injector configuration as that just described here also applies to the axial fresh-air/flue-gas mixture formation (cf. FIG. 1). The inflow cross section 18

(cf. FIG. 1) is here likewise covered with a number of injector nozzles which function according to the same principle as the injector nozzles 23*a*, 24*a*, which is also apparent in symbolized form from FIG. 1. Accordingly, all inflow openings for the fresh air 19 before its mixture formation with flue gas 20 in the direction of flow toward the interior space of the premix burner 100 are provided with a close network of injector nozzles, which determine the degree of the fresh-air/flue-gas mixing.

Figure 3:
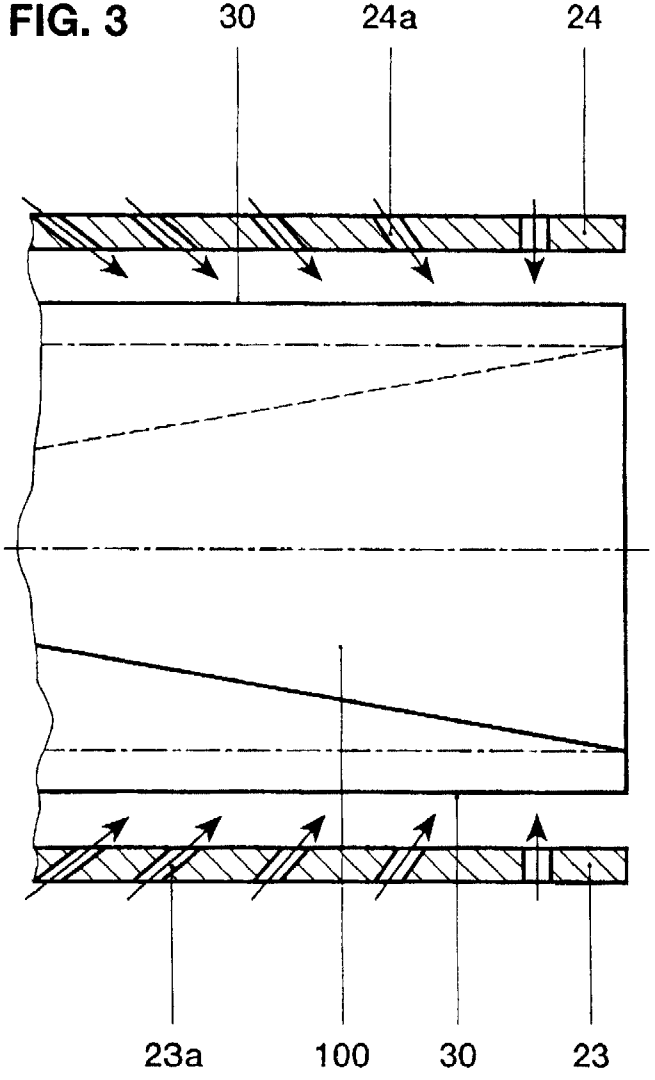
FIG. 3 shows a schematic representation of the premix burner according to FIG. 2, from which the configuration of the injector system in the direction of flow is apparent.

FIG. 3 is a schematic representation of the premix burner 100 in the direction of flow, wherein in particular the course of the perforated plates 23, 24 belonging to the injector system relative to the inflow planes 30 of the feed ducts 25, 26 finds expression. This course is parallel, the inflow planes 30 themselves running parallel to the burner axis of the premix burner 100 over the entire burner length. It is also apparent in this figure how the injector nozzles 23*a*, 24*a* vary their inflow angle relative to the burner axis of the premix burner 100 in the direction of flow. From an initial acute angle in the region of the head stage of the premix burner 100, they gradually straighten up until they are approximately perpendicular to the burner axis in the region of the outlet. By this measure, the mixing quality of the combustion air is increased and the backflow zone is influenced in a positionally stable manner.

Figure 4:
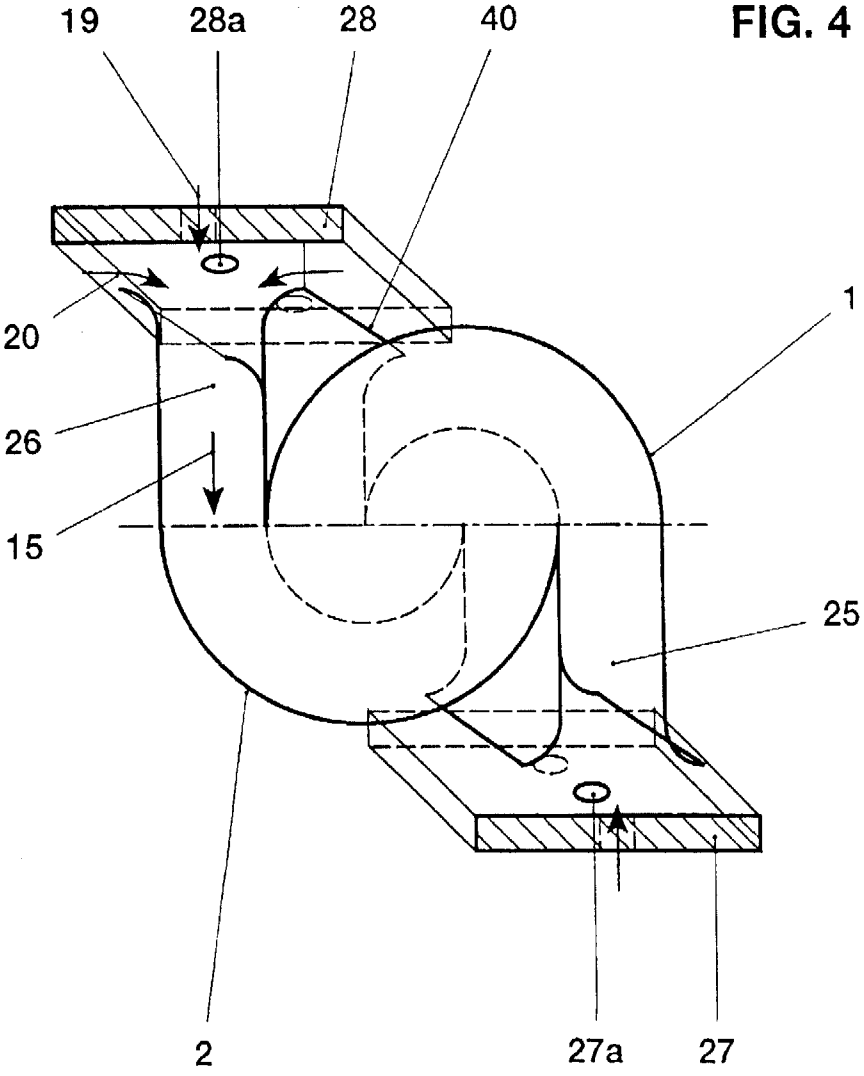
FIG. 4 shows a further course of the inflow plane of the feed ducts.
Figure 5:
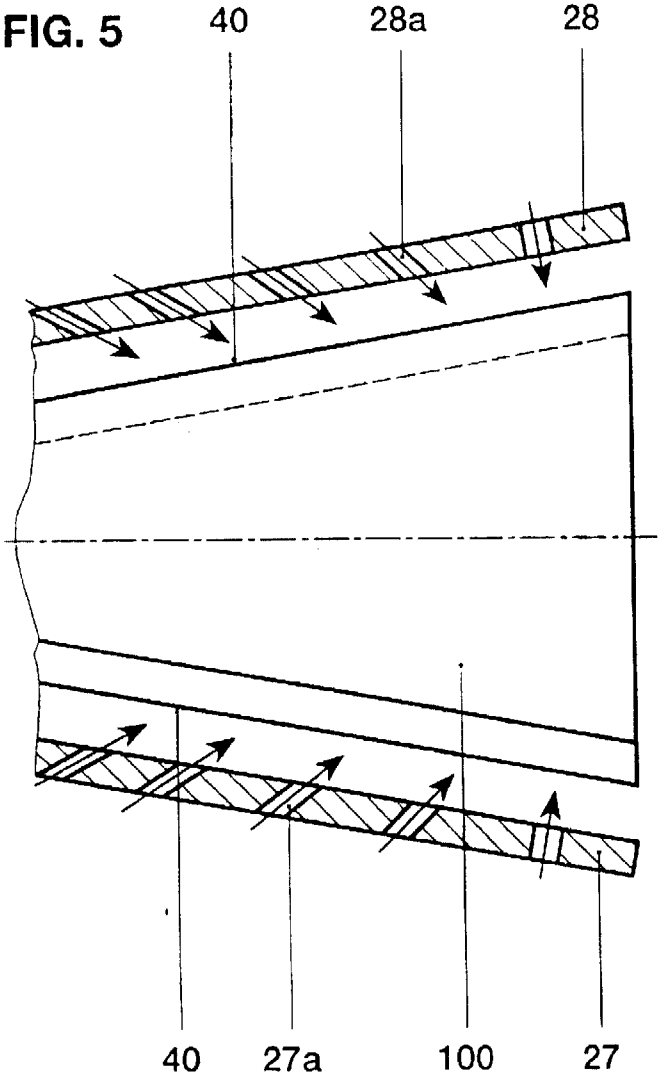
FIG. 5 shows a schematic representation of the premix burner according to FIG. 4, from which a further configuration of the injector system is apparent.

FIGS. 4 and 5 show essentially the same configuration as FIGS. 2 and 3, the perforated plates 26, 27 with the associated injector nozzles 26*a*, 27*a* likewise running parallel to the inflow planes 40 of the feed ducts 25, 26 over the entire burner length. However, these inflow planes 40 run conically relative to the burner axis of the premix burner 100. The variable inflow angle of the injector nozzles 26*a*, 27*a* in the direction of flow also largely corresponds here to the configuration according to FIGS. 2 and 3, the gradual straightening-up of these injection nozzles 26*a*, 27*a* to a perpendicular inflow in the region of the outlet of the premix burner 100 being oriented here primarily relative to the inflow plane 40 of the respective feed duct.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A premix burner comprising at least two hollow conical sectional bodies which are nested one inside the other in the direction of flow and form an interior space, the center axes of these sectional bodies running offset from one another in longitudinal direction in such a way that tangential air-inlet slots for the feeding of combustion air into the interior space result, the premix burner being operable with at least one fuel nozzle, and feed ducts extending at least upstream of the tangential air-inlet slots, which feed ducts have at least one injector system for the provision of the combustion air consisting of fresh air and flue gas, wherein perforated plates (23, 24; 27, 28) belonging to the injector system run parallel to the inflow planes (30, 40) extending across an entrance for combustion air (15) into the feed ducts (25, 26), wherein the perforated plates are provided with injector nozzles (23*a*, 24*a*; 27*a*, 28*a*) in a region of the entrance for combustion air into the fuel ducts, and wherein the inflow angle of the injector nozzles is progressively variable in a longitudinal direction of the premix burner (100) and relative to the burner axis.

2. The premix burner as claimed in claim 1, wherein the inflow angle of the injector nozzles (23*a*, 24*a*; 27*a*, 28*a*) gradually increases along the perforated plates (23, 24; 27, 28) until it is substantially perpendicular to the plane extending across the entrance of the feed ducts (25, 26).

3. The premix burner as claimed in claim 1, wherein the premix burner (100) is provided with at least one of a first fuel nozzle (3) at an entrance to the burner and arranged longitudinally of the burner axis and a plurality second of fuel nozzles (17) arranged in the region of the tangential air-inlet slots (21, 22).

4. The premix burner as claimed in claim 3, wherein the first fuel nozzle (3) can be operated with a liquid fuel (12) and the second fuel nozzles (17) can be operated with a gaseous fuel (13).

5. The premix burner as claimed in claim 1, wherein the sectional bodies (1, 2) form a uniformly increasing cross section of flow in the direction of flow.

6. The premix burner as claimed in claim 1, wherein the sectional bodies (1, 2) form a non-uniformly increasing cross section of flow in the direction of flow.

7. The premix burner as claimed in claim 1, wherein the sectional bodies (1, 2) form a uniformly or non-uniformly decreasing cross section of flow in the direction of flow.

8. The premix burner as claimed in claim 1, wherein the cross section of flow of the tangential air-inlet slots (21, 22) decreases in the longitudinal direction of the premix burner (100).

* * * * *